US010295295B2

(12) United States Patent
Shaffer et al.

(10) Patent No.: US 10,295,295 B2
(45) Date of Patent: May 21, 2019

(54) SPEED-SENSITIVE CROSSBOW COCKING DEVICE

(71) Applicant: Hunter's Manufacturing Company, Inc., Suffield, OH (US)

(72) Inventors: Michael Shaffer, Mogadore, OH (US); Eric VanKeulen, North Canton, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 15/898,815

(22) Filed: Feb. 19, 2018

(65) Prior Publication Data

US 2019/0011212 A1 Jan. 10, 2019

Related U.S. Application Data

(60) Provisional application No. 62/528,693, filed on Jul. 5, 2017.

(51) Int. Cl.
*F41B 5/12* (2006.01)

(52) U.S. Cl.
CPC ..... *F41B 5/12* (2013.01)

(58) Field of Classification Search
CPC ..... F41B 5/12; F41B 5/123
See application file for complete search history.

(56) References Cited

U.S. PATENT DOCUMENTS

| | | | |
|---|---|---|---|
| 2,092,361 | A | 9/1937 | Shim |
| 3,043,287 | A | 7/1962 | Nelson |
| 3,561,419 | A | 2/1971 | Cucuzza, Sr. |
| 3,670,711 | A | 6/1972 | Firestone |
| 3,739,765 | A | 6/1973 | Moore |
| 4,192,281 | A | 3/1980 | King |
| 4,246,883 | A | 1/1981 | Ash |
| 4,593,675 | A | 6/1986 | Waiser |
| 4,603,676 | A | 8/1986 | Luoma |
| 4,649,892 | A | 3/1987 | Bozek |
| 4,662,345 | A | 5/1987 | Stephens |
| 4,665,885 | A | 5/1987 | Glomski et al. |
| 4,719,897 | A | 1/1988 | Gaudreau |
| 4,721,092 | A | 1/1988 | Waiser |
| 4,942,861 | A | 7/1990 | Bozek |
| 5,115,795 | A | 5/1992 | Farris |
| 5,205,267 | A | 4/1993 | Burdick |

(Continued)

OTHER PUBLICATIONS

A Guide to the Crossbow, by W.F. Paterson, published by the Society of Archer-Antiquaries, 1990.

(Continued)

*Primary Examiner* — John Ricci

(74) *Attorney, Agent, or Firm* — Emerson Thomson Bennett, LLC

(57) ABSTRACT

Provided is a crossbow cocking device comprising a speed-sensitive clutch having a housing; an input shaft in operational engagement with an associated crossbow cocking cable, and in selectable rotational engagement with said housing; and wherein, below a critical rotational speed of the input shaft with respect to the housing, the speed-sensitive clutch will maintain a disengaged state, and at or above the critical speed of the input shaft with respect to the housing, said speed sensitive clutch will automatically switch to an engaged state.

20 Claims, 7 Drawing Sheets

(56) References Cited

U.S. PATENT DOCUMENTS

| | | | | |
|---|---|---|---|---|
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,624,725 | B1 | 12/2009 | Choma | |
| 7,784,453 | B1 | 8/2010 | Yehle | |
| 7,997,258 | B2 * | 8/2011 | Shepley | F41B 5/12 124/25 |
| 8,443,790 | B2 | 5/2013 | Pestrue | |
| 8,499,753 | B2 | 8/2013 | Bednar | |
| 9,404,706 | B2 * | 8/2016 | Khoshnood | F41B 5/1469 |
| 9,752,844 | B1 * | 9/2017 | Huang | F41B 5/12 |
| 9,958,232 | B1 * | 5/2018 | Egerdee | F41B 5/12 |
| 2006/0086346 | A1 | 4/2006 | Middleton | |
| 2010/0170488 | A1 | 1/2010 | Rasor et al. | |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

SPEED-SENSITIVE CROSSBOW COCKING DEVICE

CROSS-REFERENCE TO RELATED APPLICATIONS

This application claims the benefit of U.S. Provisional Application No. 62/528,693, filed Jul. 5, 2017, the entirety of which is fully incorporated by reference herein.

I. BACKGROUND

The present subject matter is directed to apparatuses and methods regarding crossbows. More specifically the present subject matter is directed to apparatuses and methods for cocking a crossbow.

Crossbows have been used for many years as a weapon for hunting and fishing, and for target shooting. Crossbows typically comprise a bowstring movable between a cocked and uncocked position. The operation of moving the bowstring to the cocked position is a cocking operation.

Cocking operations are sometime assisted using a cocking device. Abortive or failed cocking operations can result in the undesirable release of energy stored in a partially cocked crossbow. It remains desirable to produce a cocking device which can help prevent undesirable release of energy stored in partially cocked crossbow.

II. SUMMARY

Provided is a crossbow cocking device comprising a speed-sensitive clutch having a housing; an input shaft in operational engagement with an associated crossbow cocking cable, and in selectable rotational engagement with said housing; and wherein, below a critical rotational speed of the input shaft with respect to the housing, the speed-sensitive clutch will maintain a disengaged state, and at or above the critical speed of the input shaft with respect to the housing, said speed sensitive clutch will automatically switch to an engaged state.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
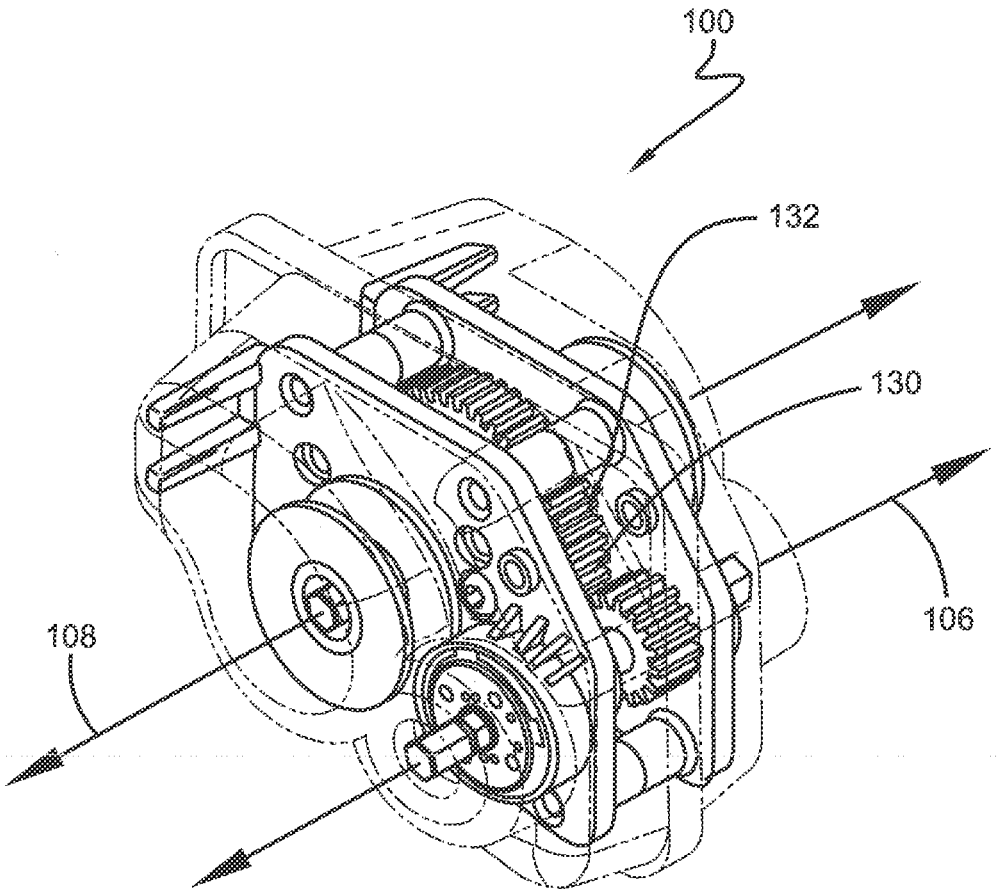
FIG. 1 is an isometric view of a first embodiment of a crossbow cocking device.

Referring now to the drawings wherein the showings are for purposes of illustrating embodiments of the present subject matter only and not for purposes of limiting the same, and wherein like reference numerals are understood to refer to like components, provided is a crossbow cocking device 100 and a method for using same. A crossbow cocking device 100 is device adapted to be used with an associated crossbow to cock the associated crossbow.

In a first embodiment, a crossbow cocking device 100 may comprise a speed-sensitive clutch 400. A speed-sensitive clutch 400 may have a housing 420 and an input shaft 470. The input shaft 470 may be in operational engagement with an associated crossbow cocking cable (not shown). The nature of the operational engagement of the input shaft 470 with the associated crossbow cocking cable may take various forms but, in general, operational engagement will be characterized by mechanical interconnection such that rotation of the input shaft 470 does work, directly or indirectly, on the cable, by either extending the cable or retracting the cable, and vice versa. The input shaft 470 may be in selectable rotational engagement with the housing 420. The nature of the selectable rotational engagement of the input shaft 470 with the housing 420 may take various forms but, in general, below a critical rotational speed of the input shaft 470 with respect to the housing 420, the speed-sensitive clutch 400 will maintain a disengaged state, and at or above the critical rotational speed of the input shaft 470 with respect to the housing 420, said speed sensitive clutch 400 will automatically switch to an engaged state.

Figure 2:
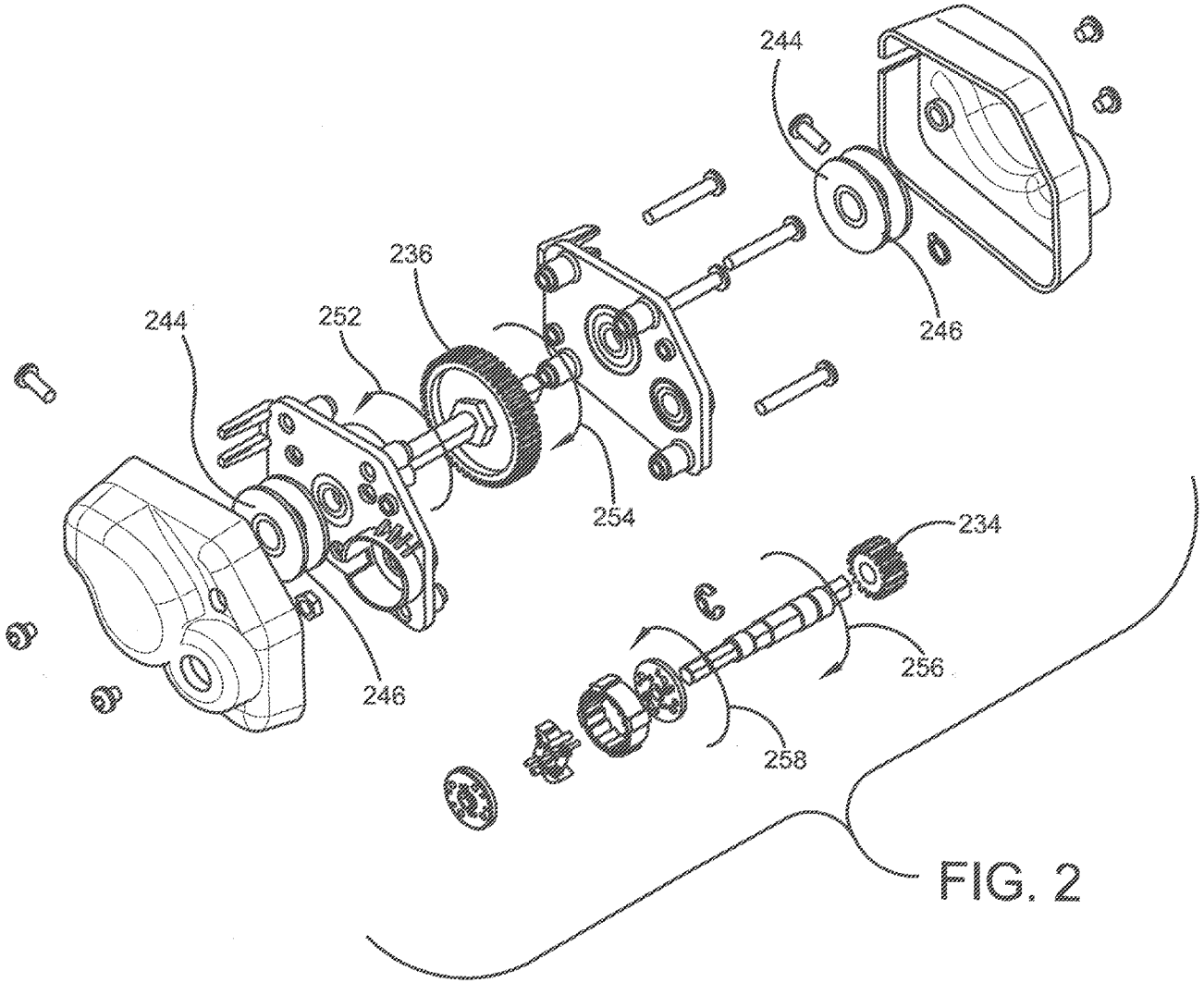
FIG. 2 is an exploded isometric view of the first embodiment of a crossbow cocking device.
Figure 3:
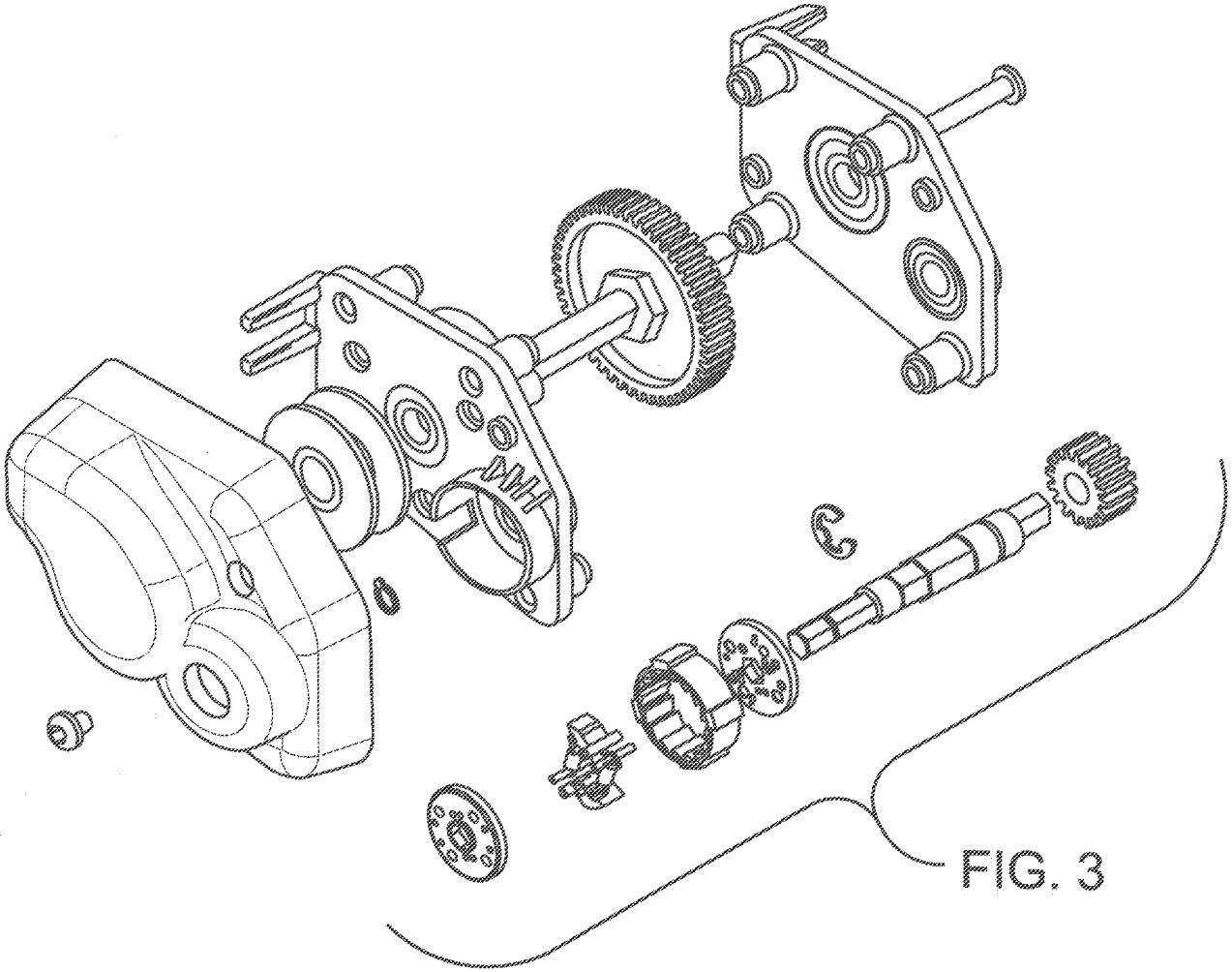
FIG. 3 is another exploded isometric view of the first embodiment of a crossbow cocking device.
Figure 4:
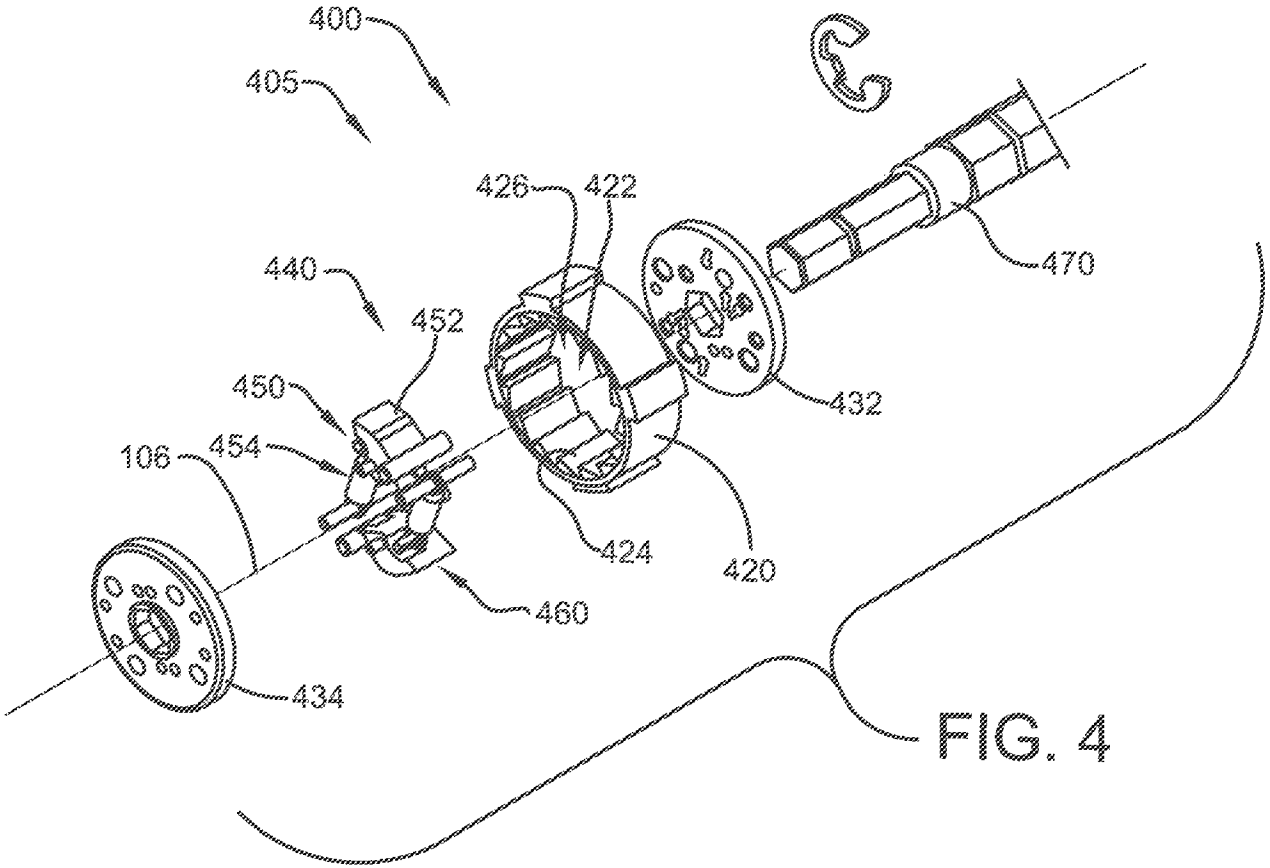
FIG. 4 is another exploded isometric view of the first embodiment of a crossbow cocking device.
Figure 5:
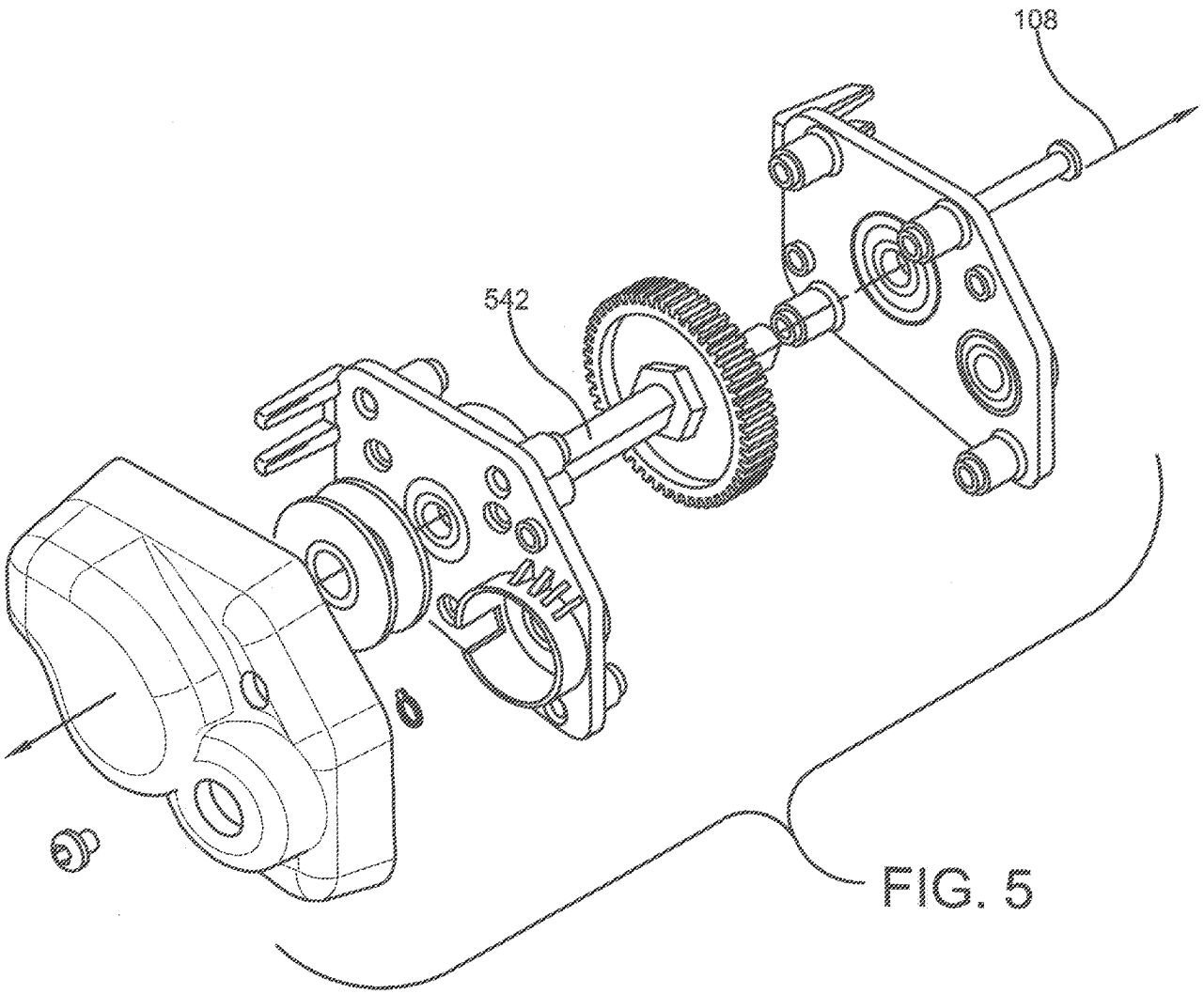
FIG. 5 is another exploded isometric view of the first embodiment of a crossbow cocking device.
Figure 6:
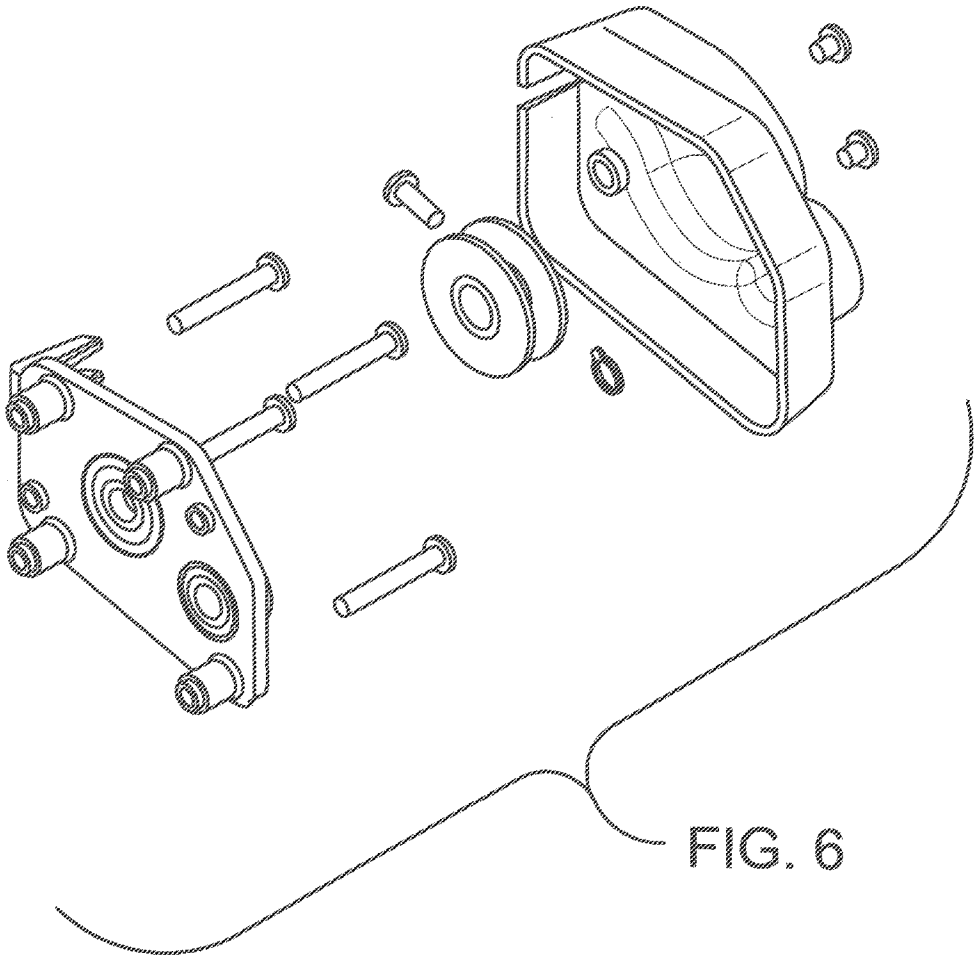
FIG. 6 is another exploded isometric view of the first embodiment of a crossbow cocking device.
Figure 7:
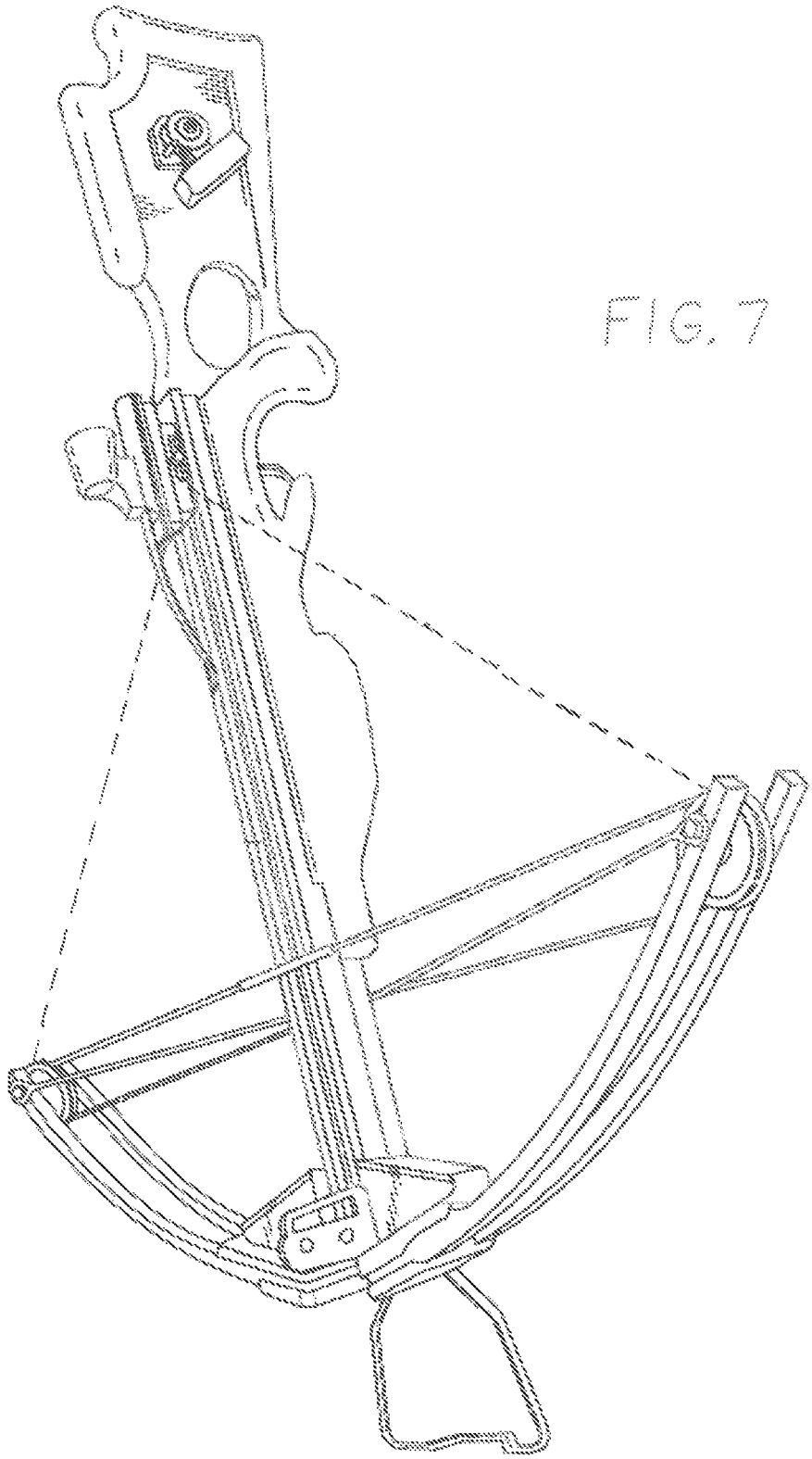
FIG. 7 shows a crossbow which may include a crossbow cocking device.

In certain embodiments a crossbow cocking device 100 may further comprise, a mechanical transmission 130 in operational engagement with the input shaft 470; a pulley shaft 542 operationally engaged with the mechanical transmission 130; and a pulley set 244 operationally engaged with the pulley shaft 542 and with the associated crossbow cocking cable. In the non-limiting embodiment shown in FIGS. 1-6, the input shaft 470 is mechanically linked to the clutch 400 so that both are adapted to rotate in conjunction with one another, as controlled by the clutch 400, about a mutually shared first axis 106. With further reference to the non-limiting embodiment shown in FIGS. 1-6, the mechanical transmission 130 may be comprised of a set of gears 132, comprising a first gear 234 intermeshed with a second gear 236. Generally, the set of gears 132 is mechanically interlinked so the gears 234, 236 therein transmit work to one another. In alternative embodiments, the mechanical transmission 130 may comprise helical gears, hypoid gears, epicyclic gearing, a linkage, a chain, a belt and pulley set, or other transmission chosen with good engineering judgment. With further reference to the non-limiting embodiment shown in FIGS. 1-6, the first gear 234 is engaged with the input shaft 470 so that both are adapted to rotate in conjunction with one another, as controlled by the clutch 400, about a mutually shared first axis 106. With further reference to the non-limiting embodiment shown in FIGS. 1-6, the second gear 236 is engaged with the pulley shaft 542 so that both are adapted to rotate in conjunction with one another, as controlled by the clutch 400, about a mutually shared second axis 108.

It should be understood that the mechanical transmission 130 may provide for some mechanical advantage that is equal to one, greater than one, or less than one. With further reference to the non-limiting embodiment shown in FIGS. 1-6, the second gear 236 is shown to be larger than the first gear 234 such that there is a mechanical advantage greater than 1.0 in transmitting torque from the input shaft 470, through the first gear 234 and into the second gear 236. This mechanical advantage may be useful to an associated user in cocking an associated crossbow with the crossbow cocking device 100. It is to be understood that the transmission will largely conserve work, with a very small amount of work being lost due to friction, such that the mechanical advantage is associated with inversely proportionate change in angular velocity. Without limitation, and by way of illustration only, if the mechanical advantage from the first gear 234 to the second gear 236 is two, then the second gear 236 will rotate at half the angular velocity of the first gear 234. With further reference to the non-limiting embodiment shown in FIGS. 1-6, in the mechanical transmission 130 shown the first gear 234 meshes directly with the second gear 236 such that, when viewed from the same side, the first gear 234 will rotate in the opposite direction from the second gear 236. In other acceptable embodiments, a mechanical transmission 130 may comprise one or more idler gears between the first gear 234 and the second gear 236 such that, when viewed from the same side, either the first gear 234 will rotate in the same direction as the second gear 236 or the first gear 234 will rotate in the direction opposite the second gear 236, as chosen with good engineering judgment.

The pulley set 244 may having one pulley 246, two pulleys 246, or some other number of pulleys 246. The pulley set 244 may be adapted to spool in cable when rotated in a first direction 252 about second axis 108. The pulley set 244 may be adapted to spool out cable when rotated in a second direction 254 about second axis 108 opposite the first direction 254 about second axis 108. As used herein, a spool in process is one in which a pulley 246 is rotated to cause an engaged cable to wind up onto the pulley 246. Conversely, the spool out process opposed to the spool in process is one in which a pulley 246 is rotated to cause an engaged cable to unwind from the pulley 246.

As noted above, a crossbow cocking device 100 is device adapted to be used with an associated crossbow to cock the associated crossbow. This adaptation defines a set of mutually opposed directions. For any given component in the crossbow cocking device 100 operable to do work as part of a cocking operation, the component may be understood to be operable in a first direction for that component and to be operable in a second direction for that component. In certain embodiments, the nature of the operational engagement of the input shaft 470 with the associated crossbow cocking cable is such that the associated crossbow cocking cable may be moved linearly in a first direction by rotating the input shaft 470 in a first direction 256 about first axis 106 and the associated crossbow cocking cable may be moved linearly in an second direction by rotating the input shaft 470 in a second direction 258 about first axis 106.

It is to be understood, that the first direction about a first axis may differ from the first direction about a second axis. With further reference to the non-limiting embodiment shown in FIGS. 1-6, as viewed from the side of the crossbow cocking device 100 closer to the foreground in FIG. 1, the first direction 256 about first axis 106 is clockwise, while the first direction about second axis 108 is counterclockwise. This difference is due to the change in motion across mechanical transmission 130. Similarly, and with further reference to the non-limiting embodiment shown in FIGS. 1-6, as viewed from the side of the crossbow cocking device 100 closer to the foreground in FIG. 1, the second direction 258 about first axis 106 is counterclockwise, while the second direction about second axis 108 is clockwise. This difference is due to the change in motion across mechanical transmission 130. It should be understood that when the crossbow cocking device 100 is rotating components on axis 108 and components on axis 106 in their respective first directions, the pulley set 244 will be moving to spool in an associated crossbow cocking cable and to cock the associated crossbow; when the crossbow cocking device 100 is rotating components on axis 108 and components on axis 106 in their respective second directions, the pulley set 244 will be moving to spool out an associated crossbow cocking cable and to uncock the associated crossbow.

As noted above, in certain embodiments, the speed-sensitive clutch 400 may have both an engaged state and a disengaged state. In certain embodiments, when the speed-sensitive clutch 400 is in an engaged state, components which are operationally engaged with the clutch 400 to receive work from the clutch 400 or transmit work to the clutch 400, are either prevented from moving in a second direction consonant with uncocking an associated crossbow; or are operationally engaged with a damper that retards motion in the second direction. In certain embodiments, the associated crossbow cocking cable may be operationally engaged with the clutch 400 to receive work from the clutch 400 or transmit work to the clutch 400 so that, when the speed-sensitive clutch 400 is in an engaged state, either the associated crossbow cocking cable is prevented from moving in a second direction consonant with uncocking an associated crossbow, or the associated crossbow cocking cable is operationally engaged with a damper that retards motion of the cable in a second direction consonant with uncocking an associated crossbow. In certain embodiments, the speed-sensitive clutch 400 is adapted to automatically switch from an engaged state to a disengaged state when the input shaft 470 is rotated in a first direction consonant with cocking an associated crossbow at a speed below the critical rotational speed. In some embodiments the speed-sensitive clutch 400 may be a centrifugal clutch 405.

With further reference to the non-limiting embodiment shown in FIGS. 1-6, in certain non-limiting embodiments, the clutch 400 may further comprise a first rotor 432, and an optional second rotor 434. The first rotor 432 is engaged with the input shaft 470 and both are adapted to rotate in conjunction with one another, as controlled by the clutch 400, about mutually shared first axis 106. The clutch 400 may further comprise a set of engagement mechanisms 440 comprising at least a first engagement mechanism 450. A set of engagement mechanisms 440 may optionally comprise a second engagement mechanism 460, a third engagement mechanism, or any number of engagement mechanisms chosen with good engineering judgment. As will be described more fully below, the set of engagement mechanisms 440 provide selectable engagement between the input shaft 470 and the housing 420.

The first engagement mechanism 450 may comprise a weighted arm 452 rotatably mounted to the rotor 432. The weighted arm 452 may be moveable between a first position wherein the arm 452 does not operationally engage the first rotor 432 to housing 420, and a second position wherein the arm 452 does operationally engage the first rotor 432 to housing 420. With further reference to the non-limiting embodiment shown in FIGS. 1-6, in certain non-limiting embodiments, the first engagement mechanism 450 may comprise a spring 454 engaged to the weighted arm 452 to apply a bias force to bias the weighted arm 452 toward the first position. The spring 454 may be a coil spring, an extension spring, a compression spring, a torsion spring, or other spring chosen with good engineering judgment. In some embodiments, the spring may be a substantially non-Hookean chosen to provide a non-linear force response resulting from deflection. In some embodiments the first engagement mechanism 450 may comprise an over-center mechanism or other system having two or more stable equilibrium states adapted to switch between a first operative state, in which the weighted arm is in the first position, to a second operative state, in which the weighted arm is in the second position. With further reference to the non-limiting embodiment shown in FIGS. 1-6, in certain non-limiting embodiments, rotation of the input shaft 470 about axis 106 rotates the first rotor 432 about axis 106 which in turn rotates the weighted arm 452 engaged therewith about axis 106. Under operational conditions in which the weighted arm 452 rotates about axis 106 at a speed at or above some critical speed as described below, the weighted arm is subjected to inertial forces of sufficient magnitude to overcome the bias force from spring 454 which bias the weighted arm 452 toward the first position, and accordingly the inertial forces will move the weighted arm 452 into engagement with the housing 420 and thereby engage the input shaft 470 with the housing 420.

With further reference to the non-limiting embodiment shown in FIGS. 1-6, in certain non-limiting embodiments, the input shaft 470 is fixedly engaged with the rotor 432 so that both rotate in conjunction with one another about axis 106; the rotor 432 is fixedly engaged with the set of engagement mechanisms 440 so that both rotate in conjunction with one another about axis 106; the set of engagement mechanisms 440 is selectably engaged with the housing 420 such that, when engaged, both rotate in conjunction with one another about axis 106 and, when disengaged, both are free to rotate independently of one another about axis 106.

It is to be understood that in some embodiments housing 420 is fixedly engaged with the crossbow cocking device 100 such that, when the set of engagement mechanisms 440 is engaged with the housing 420, the components engaged to rotate in conjunction with the housing 420 will be likewise fixedly engaged with respect to the crossbow cocking device 100. In such embodiments, if the speed-sensitive clutch 400 is in an engaged state, the associated crossbow cocking cable is prevented from moving in a second direction.

It is to be understood that in some embodiments housing 420 may be engaged with the crossbow cocking device 100 through a damper such that, when the set of engagement mechanisms 440 is engaged with the housing 420, the components engaged to rotate in conjunction with the housing 420 will be likewise engaged through the damper to the crossbow cocking device 100 and thereby their rotation with respect to the crossbow cocking device 100 will be damped. As used here in a damper is a device that dissipates kinetic energy as heat. In some embodiments, and without limitation, a damper may comprise a dashpot, shock absorber, elastomeric bushing or strap, friction damper, or rotary damper. In some embodiments, and without limitation, a damper may comprise a continuous rotation dashpot for which resistance to rotation is a positive linear, or nearly linear, function of angular velocity. In such embodiments, if the speed-sensitive clutch 400 is in an engaged state, the associated crossbow cocking cable is operationally engaged with the damper so that it that retards motion of the cable in a second direction.

In some embodiments, the damper described above may be replaced by or supplemented with a generator adapted to convert kinetic energy to electrical energy.

The housing 420 may comprise a set of engagement features 422 adapted facilitate or modify operational engagement of the set of engagement mechanisms 440 to the housing 420. The set of engagement features 422 may comprise one or more teeth 424. The set of engagement features 422 may comprise one or more teeth 424.

With further reference to the non-limiting embodiment shown in FIGS. 1-6, in certain non-limiting embodiments, the set of engagement features 422 may form a directionally-biased teeth arrangement 426. The directionally-biased teeth arrangement 426 is adapted to engage the weighted arm 452 of first engagement mechanism 450 in such a manner that, when the weighted arm is engaged with the housing, the weighted arm is prevented from moving in an second direction, and the weighted arm is not prevented from moving in a first direction; and when the weighted arm is moved in a first direction, the clutch will automatically switch to a disengaged state.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

What is claimed is:

1. A crossbow cocking device comprising
- a speed-sensitive clutch having
  - a housing;
  - an input shaft
    - in operational engagement with an associated crossbow cocking cable, and
    - in selectable rotational engagement with said housing; and
- wherein,
  - below a critical rotational speed of the input shaft with respect to the housing, the speed-sensitive clutch will maintain a disengaged state, and at or above the critical speed of the input shaft with respect to the housing, said speed sensitive clutch will automatically switch to an engaged state.

2. The crossbow cocking device of claim 1,
- wherein the associated crossbow cocking cable may be moved in a first direction by rotating the input shaft in a first direction; and
- wherein the associated crossbow cocking cable may be moved in an second direction by rotating the input shaft in a second direction.

3. The crossbow cocking device of claim 2, wherein, if the speed-sensitive clutch is in an engaged state,
- the associated crossbow cocking cable is prevented from moving in a second direction; or
- the associated crossbow cocking cable is in operational engagement with a damper that retards motion of the cable in an second direction.

4. The crossbow cocking device of claim 3, wherein the speed-sensitive clutch is adapted to automatically switch from an engaged state to a disengaged state by rotating the input shaft in a first direction at a speed below the critical rotational speed.

5. The crossbow cocking device of claim 4, further comprising
- a mechanical transmission in operational engagement with the input shaft;
- a pulley shaft in operational engagement with the mechanical transmission;
- a pulley set in operational engagement with the pulley shaft and with the associated crossbow cocking cable;
- wherein,
  - the pulley set is adapted to spool in cable when rotated in a first direction, and
  - the pulley set is adapted to spool out cable with rotated in an second direction.

6. The crossbow cocking device of claim 5, wherein said speed-sensitive clutch is a centrifugal clutch.

7. The crossbow cocking device of claim 6, wherein said speed-sensitive clutch comprises a a first rotor operationally engaged to the input shaft to transmit torque therebetween, and rotationally engaged to the housing;

a weighted arm rotatably mounted to the rotor, the weighted arm being movable between a first position wherein the arm does not operationally engage the first rotor to housing, and a second position wherein the arm does operationally engage the first rotor to housing;

a spring engaged to the weighted arm to apply a force to bias the weighted arm toward the first position;

wherein, rotation of the input shaft rotates the first rotor and the weighted arm, rotation of the weighted arm at a speed at or above the critical speed results in inertial forces on the weighted arm of sufficient magnitude to overcome the force to bias the weighted arm toward the first position and move the weighted arm into engagement with the housing and thereby engage the input shaft with the housing.

8. The crossbow cocking device of claim 7, wherein said housing comprises an annular enclosure with directionally biased teeth adapted to engage the weighted arm in such a manner that, a) when the weighted arm is engaged with the housing, the weighted arm is prevented from moving in an second direction, and the weighted arm is not prevented from moving in a first direction; and b) when the weighted arm is moved in a first direction, the clutch will automatically switch to a disengaged state.

9. The crossbow cocking device of claim 8, wherein, if the speed-sensitive clutch is in an engaged state, the associated crossbow cocking cable is prevented from moving in an second direction.

10. The crossbow cocking device of claim 8, wherein, if the speed-sensitive clutch is in an engaged state, the associated crossbow cocking cable is operationally engaged with a damper that retards motion of the cable in an second direction.

11. A method of using a crossbow cocking device comprising, providing an associated crossbow having an associated bow string movable in a first direction, and movable in an second direction;

providing an associated crossbow cocking cable;

providing a crossbow cocking device having, a speed-sensitive clutch having a housing, an input shaft in operational engagement with the associated crossbow cocking cable, and in selectable rotational operational engagement with said housing, and wherein, below a critical rotational speed of the input shaft with respect to the housing, the speed-sensitive clutch will maintain a disengaged state, and at or above the critical speed of the input shaft with respect to the housing, said speed sensitive clutch will automatically switch to an engaged state; and, engaging the input shaft to the bow string with the associated crossbow cocking cable.

12. The method of using a crossbow cocking device of claim 11, wherein the speed-sensitive clutch is adapted to automatically switch from an engaged state to a disengaged state by rotating the input shaft in a first direction at a speed below the critical rotational speed.

13. The method of using a crossbow cocking device of claim 12, wherein the crossbow cocking device further comprises a mechanical transmission in operational engagement with the input shaft to transmit torque and work therebetween;

a pulley shaft in operational engagement with the mechanical transmission to transmit torque and work therebetween;

a pulley set in operational engagement with the pulley shaft to transmit torque and work therebetween, and in operational engagement with the associated crossbow cocking cable, wherein, the pulley set is adapted to spool in cable when rotated in a first direction, and the pulley set is adapted to spool out cable with rotated in a second direction.

14. The method of using a crossbow cocking device of claim 13, wherein said speed-sensitive clutch further comprises a first rotor in operational engagement with the input shaft to transmit torque therebetween, and rotationally engaged to the housing, a weighted arm in operational engagement with the rotor, the weighted arm being movable between a first position wherein the arm does not operationally engage the housing, and a second position wherein the arm does operationally engage housing, a spring in operational engagement with the weighted arm to apply a force to bias the weighted arm toward the first position, wherein, rotation of the input shaft rotates the first rotor and the weighted arm, rotation of the weighted arm at a speed at or above the critical speed results in inertial forces on the weighted arm of sufficient magnitude to overcome the force to bias the weighted arm toward the first position and move the weighted arm into the second position thereby engaging the arm, and the rotor and the input shaft operationally engaged therewith, with the housing; and wherein said housing comprises an enclosure with directionally biased gear teeth adapted to engage the weighted arm in such a manner that, a) when the weighted arm is engaged with the housing, the weighted arm is prevented from moving in an second direction, and the weighted arm is not prevented from moving in a first direction, and b) when the weighted arm is moved in a first direction, the clutch will automatically switch to a disengaged state.

15. The method of using a crossbow cocking device of claim 14, further comprising moving the associated crossbow cocking cable in a first direction by rotating the input shaft in a first direction; or moving the associated crossbow cocking cable in a second direction by rotating the input shaft in a second direction.

16. The method of using a crossbow cocking device of claim 15, further comprising storing energy in the associated crossbow by performing at least a partial cocking operation having the step of rotating the input shaft with respect to the housing at a speed below the critical rotational speed in order to move the associated bow string operationally engaged therewith in a first direction;

releasing the associated bow string by releasing the input shaft operationally engaged therewith to rotate with respect to the housing;

using the energy stored in the associated crossbow to accelerate the associated bow string and to accelerate the input shaft operationally engaged therewith to the critical rotational speed;

switching the speed sensitive clutch automatically to an engaged state whereby the associated crossbow cocking cable and associated bow string are operationally engaged with a damper that retards motion of the cable in an second direction but still permits some damped motion;

using the energy stored in the associated crossbow to move the associated bow string into a fully uncocked position while engaged with the damper.

17. The method of using a crossbow cocking device of claim 15, further comprising storing energy in the associated crossbow by performing at least a partial cocking operation having the step of rotating the input shaft with respect to the housing at a speed below the critical rotational speed in order to move the associated bow string operationally engaged therewith in a first direction;

releasing the associated bow string by releasing the input shaft operationally engaged therewith to rotate with respect to the housing;

using the energy in the associated crossbow to accelerate the associated bow string and to accelerate the input shaft operationally engaged therewith to the critical rotational speed;

switching the speed-sensitive clutch automatically to an engaged state whereby the associated crossbow cocking cable and associated bow string are operationally engaged with a stop that prevents motion of the cable in an second direction;

disengaging the speed-sensitive clutch by rotating the input shaft with respect to the housing at a speed below the critical rotational speed in a first direction; and rotating the input shaft with respect to the housing at a speed below the critical rotational speed in a second direction to move the associated bow string into a fully uncocked position.

18. A crossbow comprising a frame;

a bow string in operational engagement with the frame and adapted be operated to be moved between an uncocked position, and a cocked position;

a crossbow cocking cable in selectable operational engagement with said bow string;

a cocking device having a housing, a pulley set in operational engagement with the crossbow cocking cable, said pulley set being adapted to spool in the crossbow cocking cable when rotated in a first direction, and spool out the crossbow cocking cable when rotated in an uncocking direction, a pulley shaft in operational engagement with the pulley set and adapted to rotate the pulley set in either a first direction or a second direction;

an input shaft in operational engagement with the pulley shaft through a mechanical transmission whereby the input shaft and the pulley shaft are mechanically linked to transmit work to one another and to impart rotational motion to one another;

a speed-sensitive clutch in operational engagement with the input shaft, the speed-sensitive clutch having a first rotor in operational engagement with the input shaft to transmit work and torque therebetween, and rotationally engaged to the housing, a weighted arm rotatably mounted to the rotor, the weighted arm being movable between a first position wherein the arm does not operationally engage the first rotor to housing, and a second position wherein the arm does operationally engage the first rotor to housing, a spring engaged to the weighted arm to apply a spring force to bias the weighted arm toward the first position;

wherein, rotation of the input shaft rotates the first rotor and the weighted arm, rotation of the weighted arm at a speed at or above the critical speed results in inertial forces on the weighted arm of sufficient magnitude to overcome the spring force to bias the weighted arm toward the first position and move the weighted arm into engagement with the housing and thereby engage the input shaft with the housing; and wherein the housing is operationally engaged with the frame.

19. The crossbow of claim 18, wherein the housing is operationally engaged with the frame through a rotatable damper.

20. The crossbow of claim 18, wherein the damper comprises a continuous rotation dashpot for which resistance to rotation is a positive linear, or nearly linear, function of angular velocity.

* * * * *